US005376188A

United States Patent [19]

Tahara et al.

[11] Patent Number: 5,376,188

[45] Date of Patent: Dec. 27, 1994

[54] METHOD OF NITRIDING AUSTENITIC STAINLESS STEEL PRODUCTS

[75] Inventors: Masaaki Tahara; Haruo Senbokuya; Kenzo Kitano; Tadashi Hayashida, all of Osaka; Teruo Minato, Wakayama, all of Japan

[73] Assignee: Daidousanso Co., Ltd., Osaka, Japan

[21] Appl. No.: 17,175

[22] Filed: Feb. 12, 1993

[30] Foreign Application Priority Data

Sep. 16, 1992 [JP] Japan ..... 4-246758

[51] Int. Cl.[5] ..... C23C 8/24; C23F 1/28

[52] U.S. Cl. ..... 148/230; 427/248.1; 156/664

[58] Field of Search ..... 148/230, 231, 234, 237; 427/248.1; 156/664

[56] References Cited

U.S. PATENT DOCUMENTS

| | | | |
|---|---|---|---|
| 4,486,462 | 12/1984 | Asahi et al. | 427/579 |
| 4,942,059 | 7/1990 | Wilson | 427/455 |
| 4,975,147 | 12/1990 | Tahara et al. . | |
| 5,013,371 | 5/1991 | Tahara et al. . | |
| 5,112,030 | 5/1992 | Tahara et al. . | |
| 5,114,500 | 5/1992 | Tahara et al. . | |
| 5,141,567 | 8/1992 | Tahara et al. . | |
| 5,176,889 | 1/1993 | Yoshino et al. . | |
| 5,205,466 | 4/1993 | Ker | 228/125 |
| 5,208,073 | 5/1993 | Yoshino . | |
| 5,254,181 | 10/1993 | Yoshino et al. | 148/232 |

FOREIGN PATENT DOCUMENTS

| | | |
|---|---|---|
| 2434183 | 6/1991 | European Pat. Off. . |
| 4036381 | 4/1991 | Germany . |
| 04143263 | 5/1992 | Japan . |
| 9208820 | 5/1992 | WIPO . |

OTHER PUBLICATIONS

Brick, Robert M., et al. Structure and Properties of Engineering Materials McGraw Hill Books, 1977 p. 342.

*Primary Examiner*—Shrive Beck
*Assistant Examiner*—Bret Chen
*Attorney, Agent, or Firm*—Armstrong, Westerman, Hattori, McLeland & Naughton

[57] ABSTRACT

A hard nitrided layer is formed on austenitic stainless steel by holding the austenitic stainless steel in a heated condition under a fluorine- or fluoride-containing atmosphere and then nitriding it so that a close uniform nitriding layer can be formed, resulting the remarkable improvement in the surface hardness of the above-mentioned austenitic stainless steel. The temperature in the above-mentioned nitriding treatment is set below 450° C. so that high anti-corrosion property, originally inherent in austenitic stainless steel, can be retained without deterioration.

7 Claims, 4 Drawing Sheets

METHOD OF NITRIDING AUSTENITIC STAINLESS STEEL PRODUCTS

FIELD OF THE INVENTION

This invention relates to a method of nitriding austenitic steel products for the improvement of anti-corrosion property and surface hardness by forming a nitrided layer on the austenitic steel surface.

BACKGROUND OF THE INVENTION

Stainless steel products, especially 18-8 stainless steel products containing about 18% of chrome (by weight; the same applies hereinafter) and about 8% of nickel have been becoming widely employed because of their superior corrosion resistance and processability. However, such products do not have quenching hardenability and also are not so superior in processing hardenability. Therefore, these products are not suitable for the use for parts demanding high wear resistance. It is common that martensitic stainless steel products, which have quenching hardenability, are applied for that purpose as a substitute. However, recently a nitrided hard 18-8 stainless steel products have increasingly used for such a use. These products are generally nitrided at temperatures between 550° to 570° C., 480° C. at the lowest.

However, both the above products of a martensitic stainless steel and a nitrided hard 18-8 stainless steel have a drawback of inferior anti-corrosion compared with an unprocessed austenitic stainless steel products. As a result of a series of studies, inventors found that the anti-corrosion property of 18-8 stainless steel products deteriorated due to the following reason. Since a crystalline chrome nitride (CrN, $Cr_2N$ and so on) is produced in a formed nitrided layer, concentration of solid soluble chrome drastically decreases. This means that active chrome disappears completely though the active chrome is indispensable to form a passive coat layer which functions to retain the anti-corrosion property of stainless steel. It is inevitable that the anti-corrosion property deteriorates when austenitic stainless steel products are nitrided. Therefore, the application range of nitriding austenitic stainless steel products to improve hardness has been limited.

OBJECT OF THE INVENTION

Accordingly it is an object of the invention to provide a method of nitriding austenitic stainless steel products which have high anti-corrosion property and surface hardness.

DISCLOSURE OF THE INVENTION

The above object is accomplished by the present invention. In a first aspect, the invention relates to a method of forming a hard nitrided layer on an austenitic stainless steel product by holding the austenitic stainless steel product in a heated condition under a fluorine- or fluoride-containing atmosphere and then holding it in a heated condition of temperature below 450° C. under nitriding atmosphere. In a second aspect, the invention related to a method of purifying the above surface by contacting strong mixed acid soluble liquid including $HNO_3$ after a nitrided layer has been formed on the austenitic stainless steel product in the first aspect.

The inventors has conducted a series of studies to obtain a stainless steel product superior in hardness without deteriorating the anti-corrosion property, originally inherent in austenitic stainless steel products. During the process of accumulated research, as aforementioned, the inventors found that a crystalline chrome nitride, which facilitates surface hardness of stainless steel products, decreases the concentration of active chrome and deteriorates the anti-corrosion property in the prior nitriding method. In other words, the concentration of solid soluble chrome drastically drops by a crystalline chrome nitride produced in a formed nitrided layer. And active chrome disappears completely, although it is indispensable to form a passive coat layer because of its function to retain the original property of anti-corrosion. As a result of further accumulated research, the inventors also found out that this phenomenon is outstanding when stainless steel products are nitrided for hardening at temperature over 450° C. while a nitrided layer having a hard surface of Vickers hardness Hv of 900 to 1,200 can be formed when stainless steel products are fluorinated to absorb N atoms and then nitrided at temperature below 450° C., in order to prevent such a phenomenon, and furthermore the deterioration of anti-corrosion lowers compared with the prior nitriding treatment at high temperature. In addition, inventors found that since the crystalline chrome nitride and iron nitride are not identified by X-ray analysis in the nitrided layer formed in a treatment below temperature of 420° C., a nitrided layer having superior anti-corrosion property can be formed because amorphous chrome nitride is produced therein. Furthermore, as aforementioned, it is further preferable that the nitrided surface can be cleaned by strong mixed acid liquid including $HNO_3$ (aftertreatment). Thus the nitriding method in this invention includes this aftertreatment.

The present invention is now described in further detail.

In the present invention, the above object can be accomplished by providing a method of nitriding an austenitic stainless steel product which comprises steps of holding austenitic steel product in a fluorine- or fluoride-containing gas atmosphere with heating and holding the fluorinated austenitic steel product in a nitriding atmosphere with heating to form the surface layer of the austenitic stainless steel product into a nitrided layer. And also, it is further preferable that the nitrided layer is purified by contacting with acid liquid including HF after the above nitriding method.

Of materials for the above austenitic stainless steel products, 18-8 austenitic stainless steel material, the most typical stainless steel material is adopted. In case that higher anti-corrosion property is required, stainless steel containing chrome more than 22% and having austenitic organization at ordinary temperature is adopted so that active chrome can be increased. And also, austenitic stainless steel including molybdenum more than 1.5% can provide the same performance in anti-corrosion property. Anti-corrosion property of the above 18-8 stainless steel may be further improved by adding this molybdenum. Furthermore, two-phase stainless steel material of austenite and ferrite ($SUS329J_1$, $SUS329J_2$) containing molybdenum more than 1.5% and chrome more than 22% is included in austenitic stainless steel of this invention. Such a two-phase stainless steel of austenite and ferrite can also provide the same performance in anti-corrosion property by the above treatment. In this case, anti-corrosion is further improved when the most surface of a nitrided layer by 3 μm to 5 μm from the uppermost is removed by dipping it into strong acid such as $HNO_3$.HF and $HNO_3$.HCl. The ordinary temperature of strong acid is acceptable, however, it may be heated up to 40° C. to 50° C., if necessary.

Fluorine- or fluoride-containing gas for a fluorine- or fluoride-containing gas atmosphere, in which the above-mentioned austenitic stainless steel product is reacted, is fluorine compound gas such as $NF_3$, $BF_3$, $CF_4$, HF, $SF_6$, $C_2F_6$, $WF_6$, $CHF_3$, or $SiF_4$. They are used independently or in combination. Besides, fluorine compound gas with F in its molecule can be used as the above-mentioned fluorine- or fluoride-containing gas. Also $F_2$ gas formed by cracking fluorine compound gas in a heat decomposition device and preliminarily formed $F_2$ gas are employed as the above-mentioned fluorine- or fluoride-containing gas. According to the case, such fluorine compound gas and $F_2$ gas are mixed for the use. The above-mentioned fluorine- or fluoride-containing gas such as the fluorine compound gas and $F_2$ gas can be used independently, but generally are diluted by an inert gas such as $N_2$ gas for the treatment. The concentration of the fluorine- or fluoride-containing gas itself in such diluted gas should amount to, for example, 10,000 to 100,000 ppm, preferably 20,000 to 70,000 ppm, more preferably 30,000 to 50,000 ppm. In the light of practicability, $NF_3$ is the best among the above compound gases. This is because $NF_3$ has chemical stability and is easy to treat since it is in a state of a gas at normal temperature.

In the invention, first of all, the above-mentioned non-nitrided austenitic stainless steel product is held in a heated condition in a fluorine- or fluoride-containing gas atmosphere of such concentration, and then fluorinated. In this case, austenitic stainless steel product is held with heating at the temperature of, for example, 300° to 550° C. The holding time of the above-mentioned austenitic stainless steel product in a fluorine- or fluoride-containing gas atmosphere may appropriately be selected depending on the austenitic stainless steel species, geometry and dimensions of the product, heating temperature and the like, generally within the range of ten or so minutes or scores of minutes. The treatment of stainless steel in such a fluorine- or fluoride-containing gas atmosphere allows "N" atoms to penetrate through the surface into the inner austenitic stainless steel. Though the mechanism of the penetration has not been proven at present yet, it can be understood as follows on the whole. That is, a passive coat layer (for example, an oxidized film) formed on the austenitic stainless steel product surface inhibits "N" atoms for nitriding from the penetration. Upon holding the austenitic stainless steel product with an oxidized layer in a fluorine- or fluoride-containing gas atmosphere with heating as mentioned above, the passive coat layer is converted to a fluorinated layer. "N" atoms for nitriding penetrate more readily into the fluorinated layer than into the passive coat layer, that is, austenitic stainless steel product surface is formed to the suitable condition for penetration of "N" atoms by the above-mentioned fluorination. Thus, it is considered that "N" atoms in the nitriding gas penetrate uniformly through the surface into an austenitic stainless steel product to a certain depth when the austenitic stainless steel product is held in a nitriding atmosphere with suitable surface condition to absorb "N" atoms as follows, resulting the formation of a deep uniform nitriding layer.

Then, as mentioned above, the austenitic stainless steel product with a suitable surface condition to absorb "N" atoms by fluorination is held with heating in a nitriding atmosphere to nitride. In this case, the nitriding gas composing a nitriding atmosphere is a simple gas composed of $NH_3$ only, or a mixed gas composed of $NH_3$ and carbon source gas (for example, RX gas), for example, a mixed gas composed of $NH_3$, CO and $CO_2$. A mixture of both gasses can be also used. Generally, the above-mentioned simple gas or gas mixture mixed with an inert gas such as $N_2$ is used. According to the case, $H_2$ gas is further added to those gasses.

In such a nitriding atmosphere, the above-mentioned fluorinated austenitic stainless steel product is held with heating. In this case, a heating condition is set at a temperature of below 450° C., which is lower than that in the prior method. Especially, the preferable temperature is between 380° and 420° C. This is the greatest characteristic in this invention. That is, when a temperature in excess of 450° C. is utilized for nitriding, crystalline CrN is generated in the nitrided layer and therefore the concentration of active chromium in the steel is decreased. As a result, the anti-corrosion property of the stainless steel deteriorates. Furthermore, the nitriding treatment between 380° and 420° C. is preferable because a superior anti-corrosion property is realized as same degree as that of austenitic stainless steel itself. On the other hand, nitriding treatment below 370° C. only realizes a nitrided hard layer less than 10 μm in depth, which is of little industrial value even if nitriding treatment time is set at 24 hours. Generally, nitriding treatment time is set within the range of 10 to 20 hours. By this nitriding treatment, a close nitriding layer of 10 to 50 μm in depth, generally 20 to 40 μm, (consisting of entirely single layer) is formed uniformly on the surface of the above-mentioned austenitic stainless steel product, whereby the surface hardness of austenitic stainless steel product reaches Vickers hardness Hv of 900 to 1200 in comparison with that of base material product thereof Hv of 250 to 450. The thickness of the hardened layer basically depends on the nitriding temperature and time.

By the way, a temperature less than 300° C. causes inefficient reaction of fluoride containing gas of $NF_3$, while a temperature over 550° C. causes excessive fluoride reaction and then furnace materials in a muffle furnace are worn out, which is not suitable for an industrial process. And also, it is preferable that the difference between fluoriding temperature and nitriding temperature is set as small as possible in order to maintain the reaction efficiency of $NF_3$.

BRIEF DESCRIPTION OF THE DRAWINGS

The above-mentioned fluoriding and nitriding steps are, for example, taken in a metallic muffle furnace as shown in FIG. 1, that is, the fluoriding treatment is carried out first, and then the nitriding treatment is put in practice at the inside of the muffle furnace. In FIG. 1, the reference numeral 1 is a muffle furnace, 2 an outer shell of the muffle furnace, 3 a heater, 4 an inner vessel, 5 a gas inlet pipe, 6 an exhaust pipe, 7 a motor, 8 a fan, 11 a metallic container, 13 vacuum pump, 14 a noxious substance eliminator, 15 and 16 cylinders, 17 flow meters, and 18 a valve. Austenitic stainless steel products 10 are put in the furnace 1 and fluorinated by introducing from cylinder 16, connected with a duct, fluorine- or fluoride-containing gas atmosphere such as $NF_3$ with heating. The gas is lead into the exhaust pipe 6 by the action of vacuum pump 13 and detoxicated in the noxious substance eliminator 14 before being spouted out. And then, the cylinder 15 is connected with a duct to carry out nitriding by introducing nitriding gas into the furnace 1. Finally, the gas is routed out via the exhaust pipe 6 and the noxious substance eliminator 14. Through the series of these operations, fluoriding and nitriding treatments are put in practice.

Particularly, the adoption of $NF_3$ as fluorine- or fluoride-containing gas is suitable for the above-mentioned fluoriding. That is, $NF_3$ is a handy gaseous substance that has no reactivity at ordinary temperature, allowing operations and detoxication of exhaust gas to be easy. In addition, in case of nitriding in the range of low temperature below 450° C., very thin high temperature oxidized film is formed on the most external surface of nitrided layer depending on the situation. This high temperature oxidized film absorbs moisture as time elapses and, as a result, causes rust. It is troublesome to remove (purify) the rust if it is formed on products of complicated shapes such as a screw because of the difficulty of physical removal such as by rubbing. When physical removal such as by rubbing is impossible, it is effective for those products to soak into strong mixed acid liquid such as $HNO_3$.HF. Since a hard layer formed at the nitriding temperature over 480° C. is extremely inferior in anti-corrosion, the hard layer easily disappears by soaking into strong acid liquid. Therefore, this is not adoptable. On the other hand, since austenitic stainless steel products related to this invention have high anti-corrosion property almost same as that of base material, it is possible to remove the oxidized scale with almost part of the hard layer remained by soaking into such a liquid. In addition, it is difficult to remove the scale only by $HNO_3$ even though it is heated up to 60° C. to 70° C. Thus a high temperature oxidized film, which is the cause of rust, can be removed by the above mentioned $HNO_3$.HF strong mixed acid treatment so that a nitrided hard layer superior in anti-corrosion can be materialized. Especially, this method is effective for parts like screws made of metastable materials such as two-phase stainless steel of austenite and ferrite or SUS304 series. This is because rubbing treatment cannot be adopted due to processed marten formed or its complicated shape on the surface. The above screws include not only screws in a narrow sense but also a various kinds of screws, bolts, nuts, pins, bushes, rivets and so on. And also, strong mixed acid includes not only $HNO_3$.HF like the above but also other mixed acids such as $HNO_3$.HCl and so on. In the above treatment, spraying is also included besides the above soaking.

In addition, when a high temperature oxidized film is removed by strong mixed acid liquid, removal of the surface by about 3 μm to 4 μm thereof realizes complete removal of oxidized film.

The following examples and comparative examples are further illustrative of the invention.

EXAMPLE 1

Figure 1:
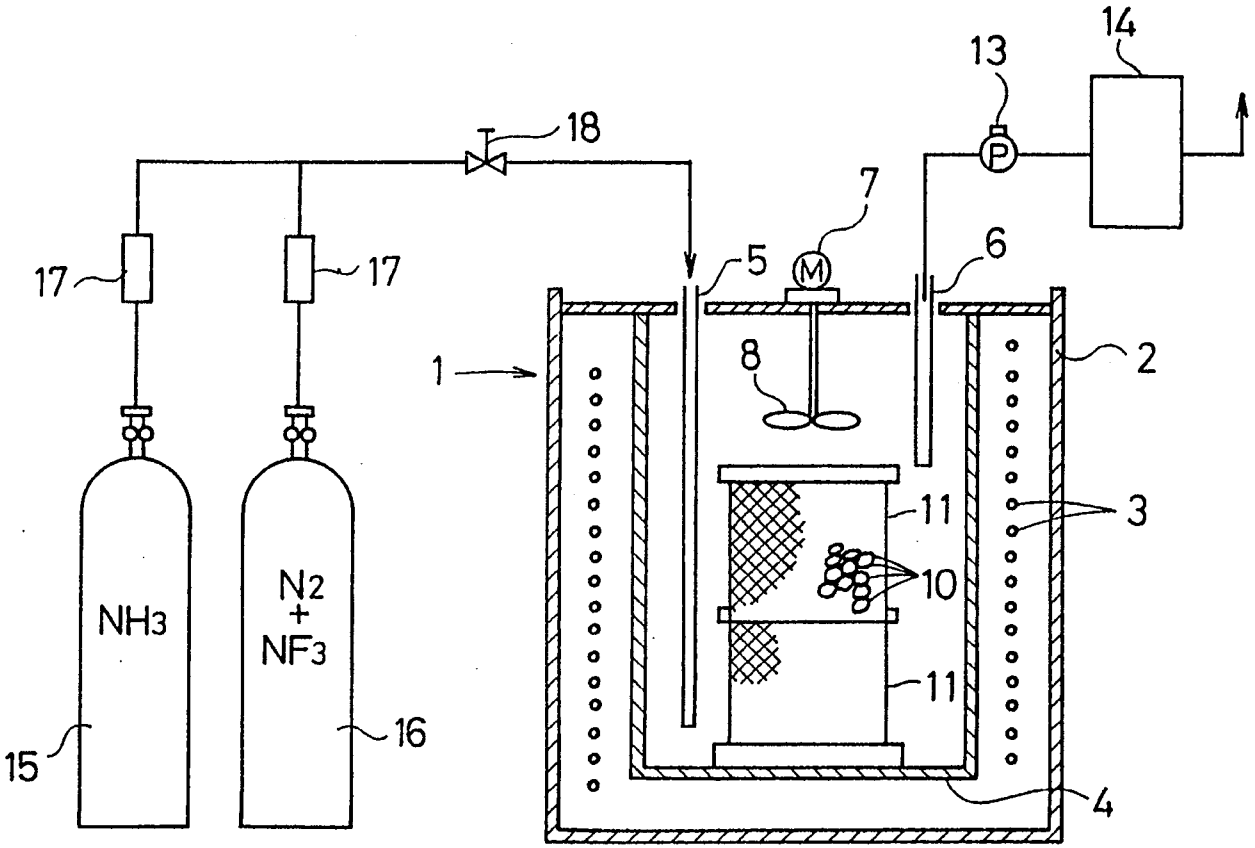
FIG. 1 schematically shows a construction of the treatment furnace 1 for carrying out nitriding according to the invention.

SUS316 plate (Chrome: 17.7%, Nickel: 13%, Molybdenum: 2%), wherein solid solution treatment had been given, was charged into a muffle furnace 1 as shown in FIG. 1. The inside of the muffle furnace 1 was vacuum-purged and heated to 300° C. Then, in that state, fluorine- or fluoride containing gas ($NF_3$ 10 vol %+$N_2$ 90 vol %) was charged into the muffle furnace 1 to form an atmospheric pressure in it and such a condition was maintained for 40 minutes. Then after exhausting the above-mentioned fluorine- or fluoride-containing gas out of the furnace 1, nitriding gas ($NH_3$ 50 vol %+$N_2$ 25 vol %+$H_2$ 25 vol %) was introduced into the furnace 1 and the inside of the furnace 1 was heated to 420° C. After nitriding treatment was carried out in this condition for 12 hours, the plate was taken away.

Through this nitriding process, surface hardness of the above SUS316 plate hardening was Hv of 980 to 1050 and the thickness was 18 μm.

Figure 2:
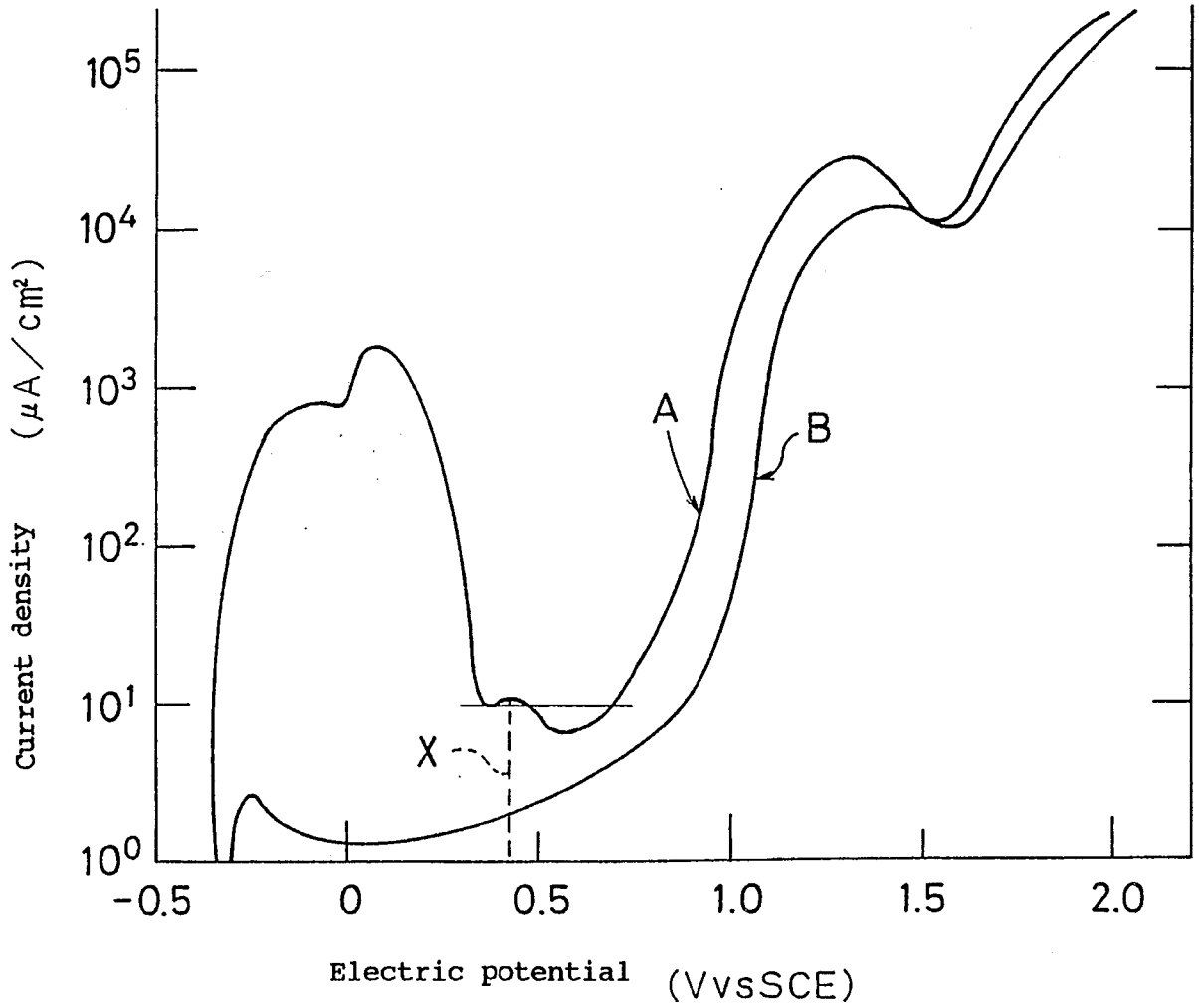
FIG. 2 shows a curve of current density and voltage on austenitic stainless steel nitrided by this invention.

In addition, in order to electrochemically check anti-corrosion property of nitrided SUS316 plate, anodic polarization test was performed (in accordance with Japanese Industrial Standard No. JIS G 0579). The result is shown in FIG. 2. From the above FIG. 2, comparing the electric current level in vicinity of a passive range (a broken line X), it is found out that nitrided plate (curve A) scarcely deteriorates compared with non-nitrided base material (curve B).

COMPARATIVE EXAMPLE 1

In Comparative Example 1, the nitriding treatment temperature was changed to 500° C. and the treatment hours to 8 hours. Except for these conditions, SUS316 plate was fluorinated and then nitrided in the same manner as Example 1. Checking the surface hardness of the above SUS316 plate in such a nitriding treatment, the Vickers hardness reached Hv of 250 to 1280, while the thickness of nitrided hard layer was 40 μm.

Figure 3:
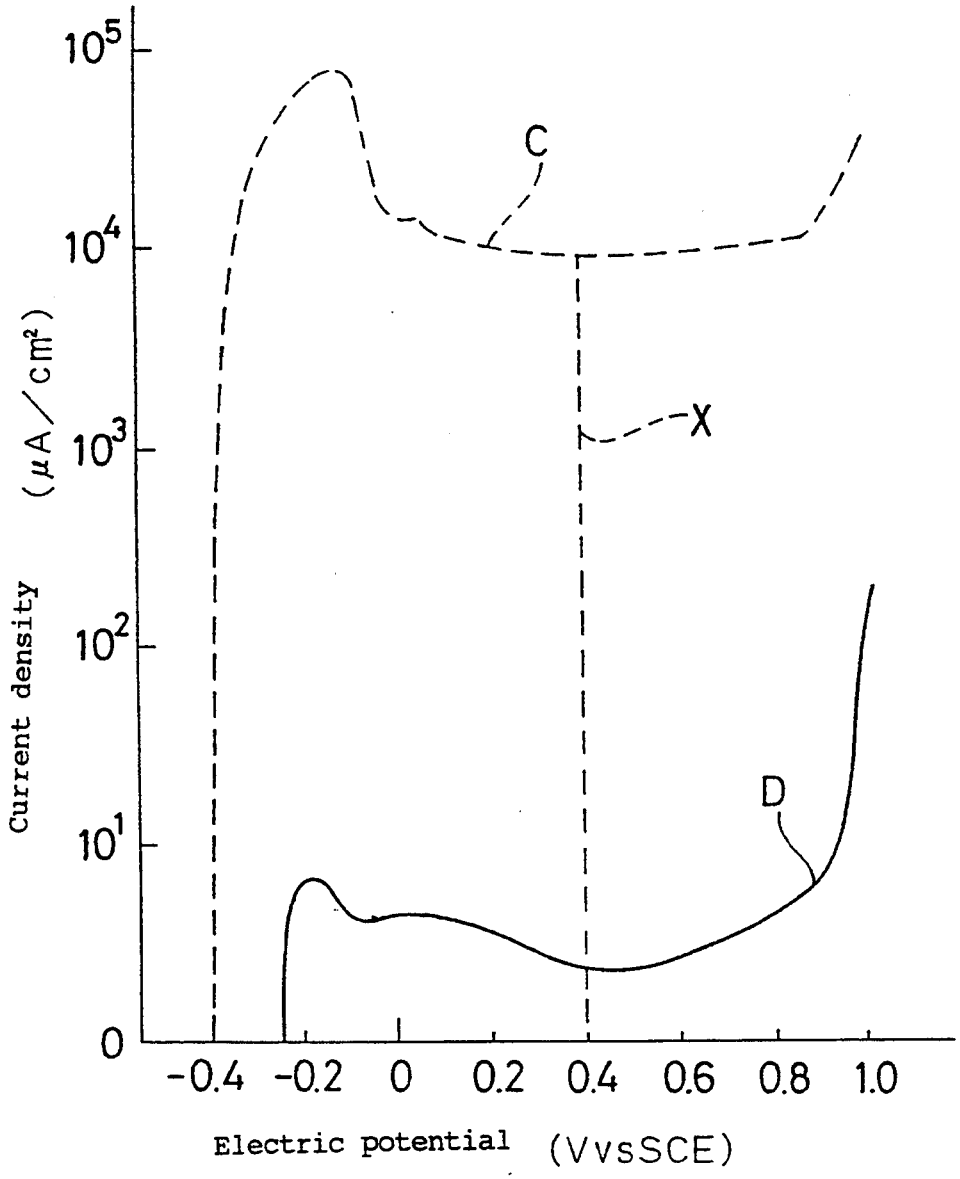
FIG. 3 shows a curve of current density and voltage on austenitic stainless steel nitrided by this invention and FIG. 4 shows a curve of current density and voltage on austenitic stainless steel nitrided by this invention.

Furthermore, in order to electrochemically determine the anti-corrosion property of the nitrided SUS 316 plate, an anodic polarization test was performed in the same manner as set forth above. The result is shown in FIG. 3. From the above FIG. 3, comparing the electric current level in vicinity of a passive range (a broken line X), it is found out that nitrided plate (curve C) has the difference of more than a number of three figures compared with non-nitrided base material (curve D), which means drastic deterioration.

In addition, salt spray test of "SST" (in accordance with Japanese Industrial Standard No. JIS 2371) was performed for each sample of the above Example 1 and Comparative Example 1. One sample of Comparative Example 1 caused rust in one hour and half. On the other hand, one sample of Example 1 did not cause rust over 320 hours. Although both of Example 1 and Comparative Example 1 were nitrided, the sample of Example 1 did not produce any rust. From this result, it is thought that nitrided hard layer in Example 1 is composed of structure near to amorphous substance and the base material before nitriding is composed of a complete austenitic organization and then active chrome remains enough.

EXAMPLE 2

SUS316 plate (Chrome: 17.8%, Nickel: 12%, Molybdenum: 2%), which had been processed (internal hardness: Hv=310~320) was prepared. The plate, whose surface was finished by rubbing with emery paper No. 1000 and buffing, was fluorinated and then maintained in the same manner as Example 1. After fluorinating, a nitriding treatment was carried out in the same manner as Example 1 for 36 hours at the temperature of 390° C. The surface hardness of this sample was Hv of 1050 to 1150 and thickness (depth) of hard layer was 18 μm. In addition, as the result of SST examination performed, these material did not cause rust over 600 hours.

EXAMPLE 3

SUS310 plate (Cr: 24.9%, Ni: 19.1%), which had been cold-rolled (internal surface Hv=370~390) was prepared. The plate was fluorinated and then nitrided same as Example 1.

Figure 4:
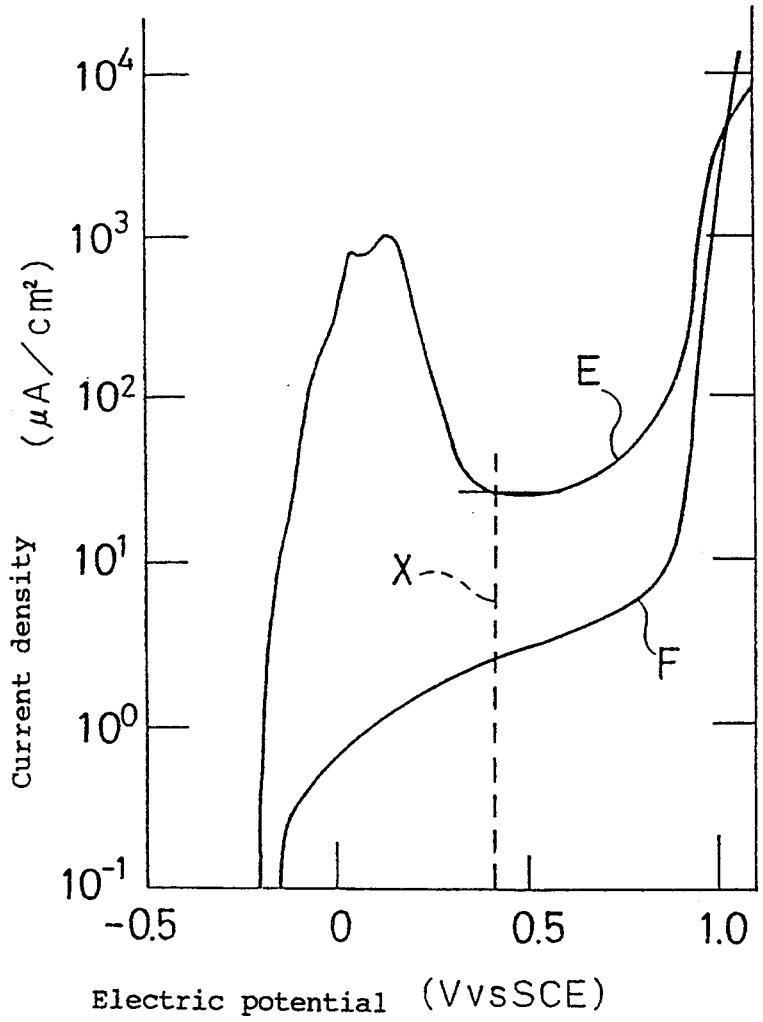

Checking the above SUS310 plate nitrided in such a way, Vickers hardness reached Hv of 1050 to 1100 and thickness of nitrided hard layer was 15 μm. And then, in order to electrochemically check the anti-corrosion property of the nitrided SUS310 plate, anodic polarization test was performed (in accordance with Japanese Industrial Standard No. JIS G 0579) as same as the above. The result is shown in FIG. 4. From the above FIG. 4, comparing the current electric level in vicinity of a passive range (a broken line X), it is found out that the difference between nitrided plate (curve E) and non-nitrided base material (curve F) is a number of one figure and it has good anti-corrosion property.

In addition, SST examination was performed for the sample of the above Example 3. As a result, rust was not caused over 680 hours. This is because enough active chrome remains to maintain the passive layer coat stably after nitriding, even though it has surface defects caused by cold working.

EXAMPLE 4

After cold rolled SUS310 plate including 24.9% of Cr and 19.1% of Ni (internal hardness: Hv=370~390) same as the above Example 2 was rubbed in the same way of Example 2 and then put into the furnace shown in FIG. 1, and then the inside of the furnace was fully vacuum-purged and heated to 400° C. Then, in that state, fluorine- or fluoride-containing gas ($NF_3$ 5 vol %+$N_2$ 95 vol %) was charged for 10 minutes into the furnace in a flow of ten times of furnace volume (eleven liter) per unit time. Then nitriding gas ($NH_3$ 50 vol %+$N_2$ 25 vol %+$H_2$ 25 vol %) was charged into the furnace at the same temperature and maintained for eight hours. Then after removing nitriding gas and charging fluorine- or fluoride-containing gas for 10 minutes, nitriding treatment was performed again by nitriding gas for eight hours. The surface hardness of SUS310 in such a nitriding treatment was almost same as the the above Example 2. However, the thickness of hard layer coat was 20 μm. In addition, as a result of SST examination, any rust was not caused over 680 hours.

EXAMPLE 5

Rolled austenitic stainless steel including 22.7% of chrome and 13% of nickel (SUS309) was prepared. The article made of this material was fluorinated and then nitrided the same as Example 1. Checking the above austenitic stainless steel nitrided in such a way, the Vickers hardness reached Hv of 1030 to 1090 and thickness of nitrided hard layer was 18 μm. And then, SST examination was performed. As a result, any rust was not caused over 680 hours.

EXAMPLE 6

A tapping screw and a socket screw were formed by pressure from austenitic stainless steel material including 19% of Cr and 9% of Ni (XM7). These samples were fluorinated and the nitrided same as Example 1. Checking the surface hardness of the austenitic stainless steel nitrided in such a way, the Vickers hardness reached Hv of 1150 to 1170 and the thickness of nitrided hard layer was 16 μm. In addition, SST examination was performed for the screw and socket screw of nitrided austenitic stainless steel. As a result, dotted rust was caused in 24 hours. And then, they were maintained in SST examination in another 48 hours, the degree of rust was remarkably light compared with the sample of Comparative Example 1.

EXAMPLE 7

A tapping screw and a socket screw the same as Example 6 were fluorinated and then nitrided as same as Example 1. However, the nitriding temperature was set more than 380° C. and the nitriding time was changed to 20 hours. The surface hardness of the sample nitrided in such a way was Hv of 980 to 1020 and the thickness of nitrided hard layer was 12 μm. In addition, dotted rust was caused in 40 hours as a result of SST examination. On the other hand, the degree of rust was further light compared with the sample of Comparative Example 1, which was nitrided at 500° C.

As is clear from the above examples, the anti-corrosion property is relatively improved when the nitriding treatment is conducted at less than 450° C. as compared with when the nitriding treatment is conducted at over 450° C. For example, the degree depends on its processing condition before nitriding, ingredients, treatment temperature and the like. Austenitic stainless steel products have surface defects because generally some processing is done to improve the strength. In case of 18-8 stainless steel such as SUS304, it is thought that anti-corrosion property is not fully improved for a certain use in spite of nitriding treatment below 400° C. In this case, when austenitic stainless steel including much chrome than 18-8 stainless stainless steel, which is now used as heat resistant steel, or austenitic stainless steel including molybdenum more than 1.5% is nitrided like the above, anti-corrosion can be realized near to the level of base material.

EXAMPLE 8

The tapping screw and the socket screw of nitrided austenitic stainless steel (XM7) obtained by the above Example 6 and 7 were dipped into 15% solution of $HNO_3$ at 35° C. including 6% of HF in one hour and then the surface high temperature oxidized layer was removed (purified). And then, SST examination was performed for those products after the above treatment. As a result, any dotted rust was not caused over 480 hours while dotted rust was caused in 24 hours in the above Example 6 and 7. In addition, the surface hardness of the above-mentioned tapping screw, etc. before acid cleaning was Hv of 1150 to 1170 and the thickness of the hard layer was 16 μm, while the surface hardness was Hv of 950 to 960 and the thickness of the hard layer became 12 μm after acid cleaning. On the other hand, in case of SUS316 nitrided at 500° C. shown in Comparative Example 1, as a result of the same acid cleaning, all the hard layer of 40 μm disappeared and the hardness indicated the value as same as that of base material.

EXAMPLE 9

In place of the austenitic stainless steel products of Example 6, a two-phase stainless steel product of austenite and ferrite ($SUS329J_1$) including 23% of chrome and 2% of molybdenum was adopted to form a tapping screw and a socket screw formed by pressure. These samples were fluorinated and then nitrided as same as the above Example 1. Checking the surface hardness of samples treated in such a way, Vickers hardness reached Hv of 1180 to 1200 and the thickness of its nitrided layer was 27 μm. In addition, these nitrided samples were dipped into the solution including HF as same as Example 8 so that surface oxidized layer was removed. As a result, the thickness of nitrided hard layer became 22 μm and the hardness was Hv of 940 to 950. Any dotted rust was not caused over 480 hours through SST examination.

EFFECT OF THE INVENTION

As mentioned hereinbefore, the method of nitriding an austenitic stainless steel product according to the invention comprises holding the austenitic stainless steel with heating in a fluorine- or fluoride-containing gas atmosphere to fluorinate and then holding it in a heated condition of temperature below 450° C. under nitriding atmosphere. According to inventors' studies, the austenitic stainless steel product contains elements such as Cr, which reacts on "N" atoms easily to generate a hard intermetallic compounds. And also "N" atoms in nitriding treatment penetrate uniformly into the surface of austenitic stainless steel to a certain depth since a formed fluorinated layer allows "N" atoms to pass through. As a result, a close nitrided hard layer can be uniformly formed to a certain depth only on the surface layer of austenitic stainless steel products wherein the surface hardness thereof is drastically improved. Furthermore, since, in this invention, nitriding treatment is performed below 450° C., a lower temperature compared with prior high temperature treatment, deterioration in superior anti-corrosion of original property for austenitic stainless steel can be restrained. Accordingly, austenitic stainless steel products superior both in hardness and anti-corrosion can be materialized. Such a restraint is prominent especially in case of adopting austenitic stainless steel such as SUS310 containing more chrome than that of 18-8 austenitic stainless steel, generally used as heat resistant steel, austenitic stainless steel containing molybdenum over 1.5%, or two-phase stainless steel of austenite and ferrite containing molybdenum over 1.5% and chrome over 22%. In case of containing molybdenum, only if there is about 18% of the concentration, anti-corrosion does not deteriorate.

What is claimed is:

1. A method of nitriding austenitic stainless steel products comprising holding austenitic stainless steel products in a fluorine-or fluoride-containing gas atmosphere with heating to form fluorinated austenitic stainless steel products, and then holding the fluorinated austenitic stainless steel products in a nitriding atmosphere with heating at a temperature below 450° to form a nitrided layer on a surface of the austenitic stainless steel products.

2. A method of nitriding austenitic stainless steel products according to claim 1, further including purifying the surface of the nitrided layer by contacting the layer with strong mixed acid liquid including $HNO_3$.

3. A method of nitriding austenitic stainless steel products according to claims 1 or 2 wherein the austenitic stainless steel products are processed articles including more than 22% by weight of chrome.

4. A method of nitriding austenitic stainless steel products according to claims 1 or 2 wherein the austenitic stainless steel products are processed products including more than 1.5% by weight of molybdenum.

5. A method of nitriding austenitic stainless steel products according to claims 1 or 2 wherein the austenitic stainless steel products are processed articles composed of two-phase stainless steel products of austenite and ferrite containing more than 1.5% by weight of molybdenum and more than 22% by weight of chrome.

6. A method of nitriding austenitic stainless steel products according to claims 1 or 2 wherein the austenitic stainless steel products are stainless screws.

7. A method of nitriding austenitic stainless steel products according to claim 1 wherein the temperature during nitriding is from 380° to 420° C.

* * * * *